United States Patent [19]

Hunt

[11] Patent Number: 5,044,327

[45] Date of Patent: Sep. 3, 1991

[54] AIR/BURNER PORT

[75] Inventor: Jeffrey D. Hunt, Copley, Ohio

[73] Assignee: The Babcock & Wilcox Company, New Orleans, La.

[21] Appl. No.: 583,050

[22] Filed: Sep. 14, 1990

[51] Int. Cl.[5] ..... F22B 37/00

[52] U.S. Cl. ..... 122/6.6; 110/182.5; 122/6.5; 431/186; 431/188; 431/189

[58] Field of Search ..... 431/186, 189, 153, 146, 431/188; 122/6.5, 6.6; 110/182.5

[56] References Cited

U.S. PATENT DOCUMENTS

| | | | |
|---|---|---|---|
| 1,391,338 | 9/1921 | Morse | 431/153 X |
| 2,186,474 | 1/1940 | Blizard | 431/153 X |
| 3,339,614 | 9/1967 | Fleck et al. | 431/186 |
| 3,486,834 | 12/1969 | Frey et al. | 431/188 X |
| 4,781,576 | 11/1988 | Dewitz | 431/189 X |
| 4,909,729 | 3/1990 | Donohue | 431/188 |

*Primary Examiner*—Edward G. Favors

*Attorney, Agent, or Firm*—Vytas R. Matas; Robert J. Edwards; Eric Marich

[57] ABSTRACT

An air/burner port assembly for a boiler having a water-wall and a windbox spaced rearwardly of the water-wall to form a windbox, comprises a burner and ignitor mounted in the windbox for directing and igniting fuel through a port in the water-wall. A damper door is mounted on linkages which are actuated by a piston and cylinder combination, for opening and closing the port. The burner comprises an atomizer which is mounted within a fixed sleeve for movement outwardly of the port when the damper is open, and inwardly of the port for allowing the damper to close.

14 Claims, 3 Drawing Sheets

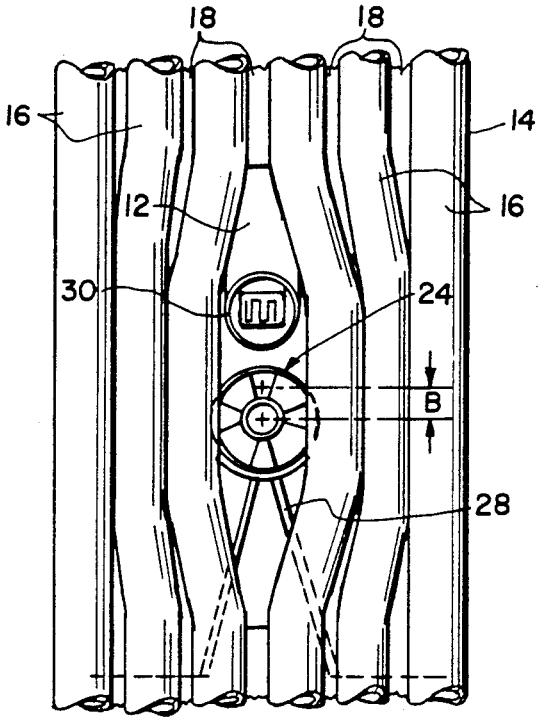
FIG. 3
FIG. 4
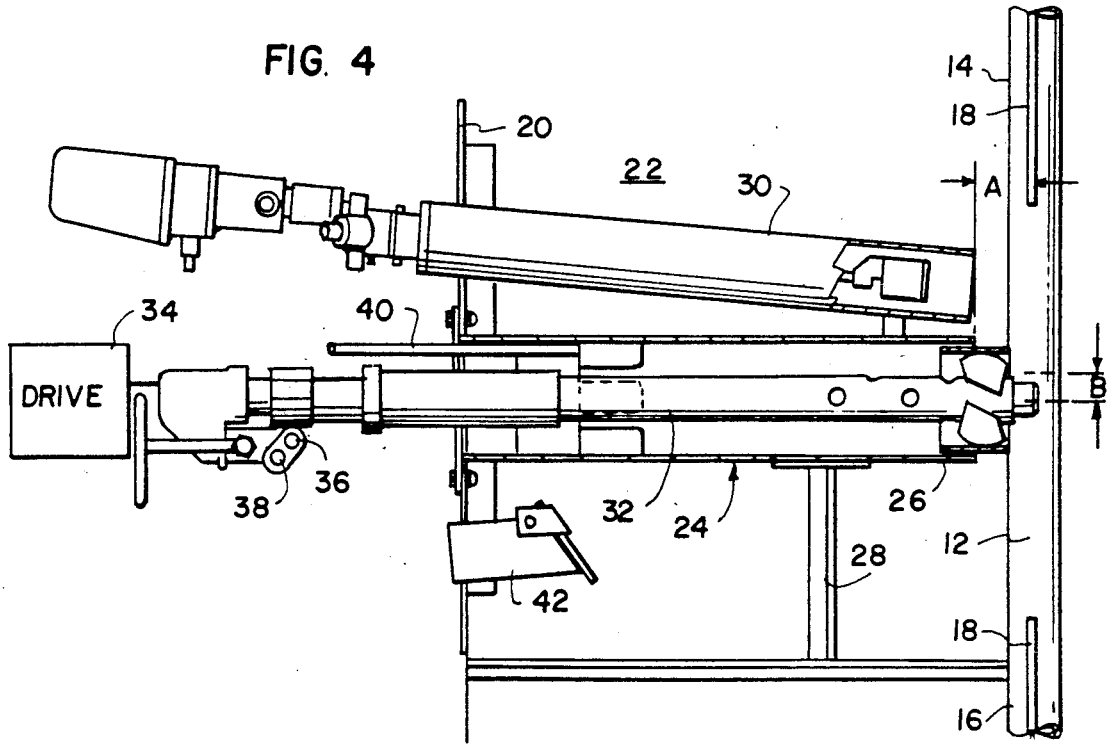

AIR/BURNER PORT

FIELD AND BACKGROUND OF THE INVENTION

The present invention relates in general to burners for oil or other fluid fuel fired boilers, and in particular to a new and useful port arrangement for supplying air and fuel to the combustion chamber of the boiler.

The construction of oil burners for boilers is disclosed in *STEAM-ITS GENERATION AND USE 39th EDITION*, published by The Babcock and Wilcox Company, 1978, pages 7-1 to 7-10.

Secondary air systems are used in process recovery boilers. These have traditionally required five standard air ports and three standard burner ports per side wall of the boiler for a total of eight pressure part openings for a 700 ton boiler. It would be advantageous if the number of ports through the side wall of the boiler could be reduced.

SUMMARY OF THE INVENTION

An object of the present invention is to reduce the number of pressure ports, i.e. air and burner ports, in the secondary system of a process recovery boiler. This object is achieved by constructing some of the ports as combination air-burner ports which supply both secondary air and fluid fuel through the side wall of the boiler. In this way, for a 700 ton boiler, the total number of boiler pressure parts is reduced from eight to five per boiler side wall. According to the invention for example, three combination air-burner ports are used with two standard air ports per boiler side wall.

A guillotine damper is used in conjunction with the combination ports for controlling the amount of secondary air. Each combination port includes an oil or fuel atomizer and a gas ignitor.

Each combination port is formed by bending water-wall tubes in the lower furnace of the process recovery boiler. A double linkage is connected to the door of the guillotine damper for centering the lifting force supplied to the door on opposite sides of the atomizer and ignitor. The atomizer is also mounted for sliding movement within a permanently installed sleeve in the wind box of the lower furnace. This permits the atomizer to be extended out beyond the door when the damper is opened for improved oil firing and efficiency, and may also be retracted into the sleeve for operation of the guillotine damper during black liquor firing. The gas ignitor is permanently attached to the sleeve and does not move.

A major advantage of the invention is in the reduction of the number of pressure parts, i.e. air and burner ports, required in the lower furnace of the recovery boiler. The invention is particularly advantageous to use when retrofitting an existing recovery boiler with a new air system, because the invention reduces the number of water-wall tube welds. The invention also reduces the cost of air systems in the recovery boilers.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

BRIEF DESCRIPTION OF THE DRAWINGS

In the drawings:

FIG. 3 is a front elevational view thereof; and

FIG. 4 is an opposite side elevational view similar to FIG. 1, with the guillotine damper removed and details of the atomizer and ignitor illustrated.

DESCRIPTION OF THE PREFERRED EMBODIMENT

Figure 1:
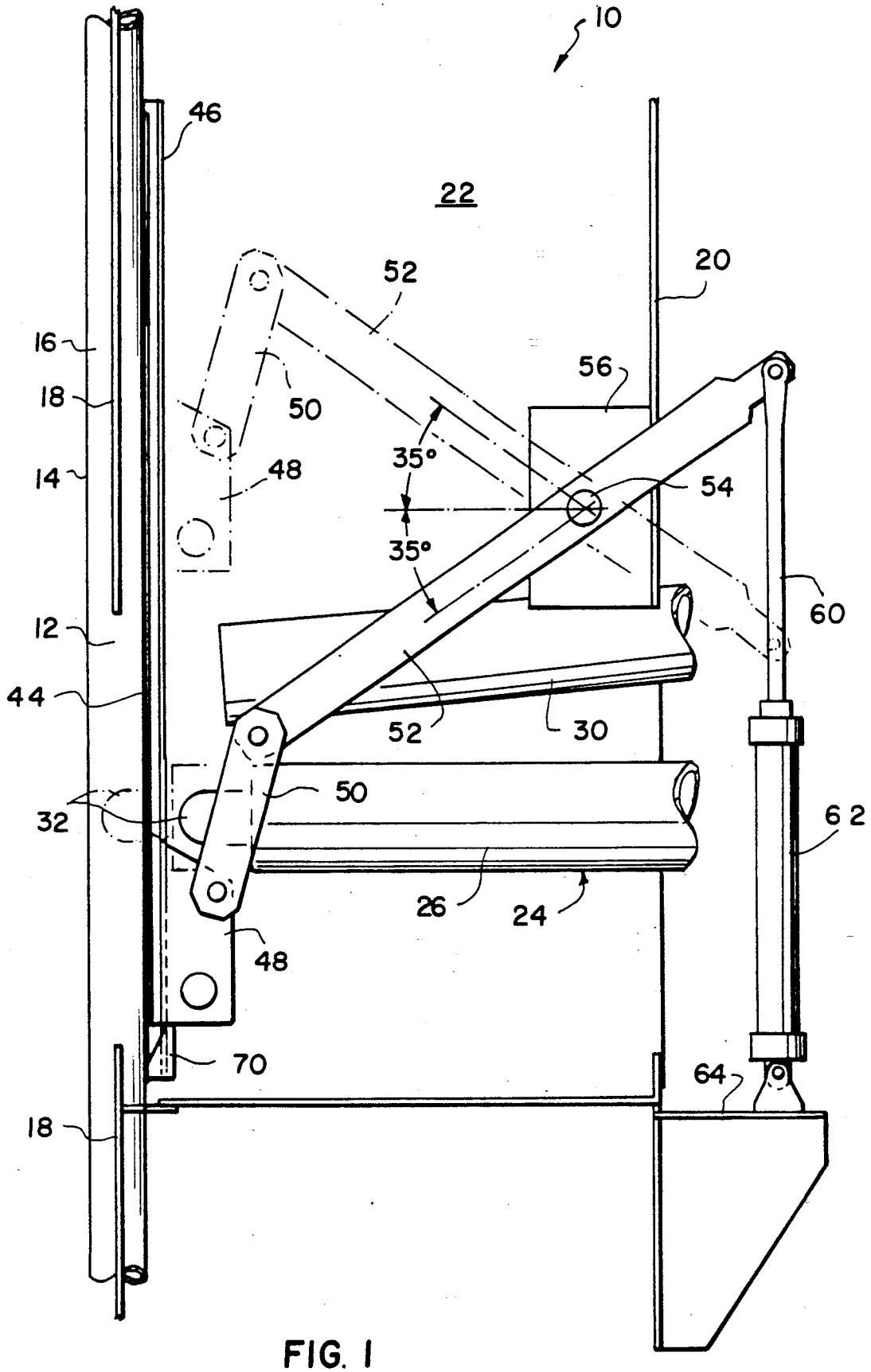
FIG. 1 is a side elevational view of a combination air/burner port assembly according to the present invention with an atomizer retracted and a guillotine damper closed.

Referring to the drawings in particular, the invention embodied therein comprises a combination air/burner port assembly generally designated 10 which operates at combination air/burner port 12 in a water-wall 14 comprising boiler tubes 16 which are welded to each other by membrane segments 18 in a conventional manner. A windbox wall 20 which is spaced rearwardly of water-wall 14, defines a windbox 22 for secondary air which is supplied outwardly through port 12. As shown in FIG. 4, a fuel burner generally designated 24 is mounted within windbox 22 and comprises a fixed outer sleeve 26 which is connected to wall 20 and fixed on a cradle and bracket 28 in the windbox 22. A gas ignitor 30 of conventional design is also fixed in windbox 22, on sleeve 26.

The forward end of sleeve 26 has a clearance "A" of approximately 4¼ inches with the membrane segment 18.

Burner 24 includes an oil or other fuel atomizer 32 which is mounted for axial movement within sleeve 26 by drive means shown schematically at 34. Atomizer 32 is shown in its extended position with its nozzle or tip through port 12. Oil or other fuel is supplied to a fuel inlet 36 and primary atomizing air is supplied to an air inlet 38 in the rear end of atomizer 32. Additional air is supplied over inlet 40 to the space within sleeve 26 to further atomize the air-fuel mixture being discharged from the tip of the atomizer 32.

A rodding port 42 also pierces wall 20 and is provided with a door for cleaning the smelt from the air port.

As best shown in FIG. 1, the tip of atomizer 32 can be retracted by drive 34 into sleeve 26 and away from the port 12. In this position, a guillotine damper having a door 44 can be lowered on a pair of door guides or rails 46, to cover port 12. Door 44 is spaced slightly behind the membrane wall segment 18 to allow for a small leakage of air from the windbox even when the door is closed.

Figure 2:
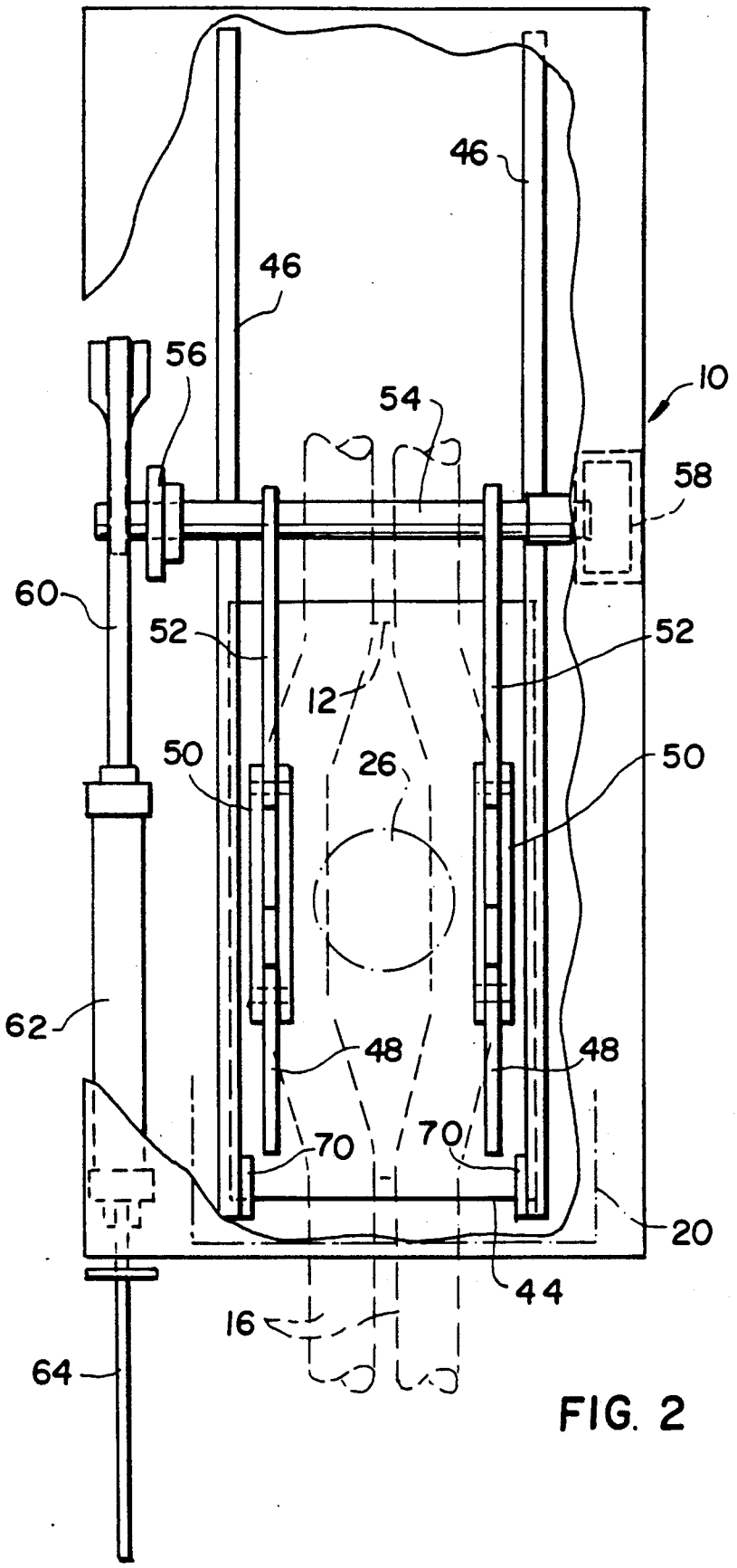
FIG. 2 is a rear elevational view thereof with the atomizer and an ignitor removed for clarity.

Door 44 is raised and lowered by its own drive means best shown in FIGS. 1 and 2. The drive means for the guillotine damper include a pair of brackets 48 which are fixed, for example by welding, to the rear of door 44. A pair of double links or linkages 50, 52 are pivotally connected to each bracket 48. The second link 52 of each double link is fixed to a shaft 54 which is pivotally mounted in a pair of bearings 56, 58 connected to the windbox wall 20. The rear end of one second link 52 is connected to the piston 60 of an air cylinder 62 fixed on a bracket 64 which is also mounted on wall 20. The raised or open position for the door is shown in phantom line in FIG. 1. Advantageously the second link 52 pivots by approximately 35° upwardly and downwardly from a horizontal position to establish the respective open and closed positions for the damper.

As shown in FIG. 3, two pairs of tubes 16 around port 12 must be bent outwardly to form the port. The membrane segment 18 is also removed from the area of the port.

To improve the efficiency of ignition, the center line of atomizer 32 is also offset by an amount "B" which is approximately 1½ inches, from the vertical center of the port 12. The atomizer and ignitor are also centered horizontally within the port 12.

As shown in FIGS. 1 and 2, a pair of stops 70 are also mounted at the lower ends of the vertical guides 46, for engagement against the brackets 48 to stop the door 44 in its lower closed position shown in solid line in FIG. 1. The piston and cylinder combination 60, 62 may also be replaced by any other appropriate actuator for moving the pair of linkages which are connected on opposite sides of the burner 26 and ignitor 30, to the door 44.

While a specific embodiment of the invention have been shown and described in detail to illustrate the application of the principles of the invention, it will be understood that the invention may be embodied otherwise without departing from such principles.

What is claimed is:

1. An air/burner port assembly for a boiler having a water-wall and a windbox wall spaced rearwardly of the water-wall to form a windbox, the assembly comprising:

means for defining a port in the water-wall communicating with the windbox;

a burner mounted in the windbox for discharging fuel through the port;

a damper door mounted for movement between a closed position at least partly covering the port and an open position spaced away from the port;

a guide fixed to the water-wall for guiding movement of the damper door between its open and closed position; and drive means mounted in the windbox and connected to the damper door for moving the damper door between the open and closed positions, the drive means including a pair of interconnect linkages connected to the door on opposite sides of the burner, the linkages being connected to each other for synchronous movement therewith, and an actuator connected to at least one of the linkages for moving the linkages to move the door between its open and closed positions.

2. An assembly according to claim 1 including an ignitor mounted in the windbox adjacent the burner for igniting fuel discharged by the burner through the port.

3. An assembly according to claim 2 wherein the burner comprises a sleeve fixed in the windbox and an atomizer mounted for axial movement in the sleeve, the atomizer having a discharge tip which is movable between an extended position extending through the port and beyond a plane containing the door in the closed position of the door, and a retracted position in the sleeve spaced away from the plane of the door.

4. An assembly according to claim 3 wherein the sleeve has a rear end fixed to the windbox wall, and a forward end spaced rearwardly of the port.

5. An assembly according to claim 4 wherein each linkage comprises a double link, the drive means including a pair of brackets connected to the door on opposite sides of the burner, each double link having a first link pivotally connected to one of the brackets, and a second link pivotally connected to the first link, a shaft rotatably mounted to the windbox wall, each second link being fixed to the shaft and one of the second links being pivotally connected to the actuator.

6. An assembly according to claim 5 wherein the actuator comprises a piston and cylinder combination connected to the windbox wall.

7. An assembly according to claim 6 wherein the guide extends vertically for vertical movement of the door, the door when in its closed position being in a plane which is spaced rearwardly of the water-wall.

8. An assembly according to claim 7 including a stop connected to the guide for stopping downward movement of the door at its closed position.

9. An assembly according to claim 1 wherein the burner comprises a sleeve fixed in the windbox and an atomizer mounted for axial movement in the sleeve, the atomizer having a discharge tip which is movable between an extended position extending through the port and beyond a plane containing the door in the closed position of the door, and a retracted position in the sleeve spaced away from the plane of the door.

10. An assembly according to claim 9 wherein the sleeve has a rear end fixed to the windbox wall, and a forward end spaced rearwardly of the port.

11. An assembly according to claim 1 wherein each linkage comprises a double link, the drive means including a pair of brackets connected to the door on opposite sides of the burner, each double link having a first link pivotally connected to one of the brackets, and a second link pivotally connected to the first link, a shaft rotatably mounted to the windbox wall, each second link being fixed to the shaft and one of the second links being pivotally connected to the actuator.

12. An assembly according to claim 1 wherein the actuator comprises a piston and cylinder combination connected to the windbox wall.

13. An assembly according to claim 11 wherein the guide extends vertically for vertical movement of the door, the door when in its closed position being in a plane which is spaced rearwardly of the water-wall.

14. An assembly according to claim 13 including a stop connected to the guide for stopping downward movement of the door at its closed position.

* * * * *